US010202665B2

(12) United States Patent
Hashimura et al.

(10) Patent No.: US 10,202,665 B2
(45) Date of Patent: Feb. 12, 2019

(54) SPRING STEEL AND METHOD FOR PRODUCING THE SAME

(71) Applicant: NIPPON STEEL & SUMITOMO METAL CORPORATION, Tokyo (JP)

(72) Inventors: Masayuki Hashimura, Kisarazu (JP); Junya Yamamoto, Nakano-ku (JP); Kazumi Mizukami, Futtsu (JP); Naotsugu Yoshida, Kimitsu (JP); Masafumi Miyazaki, Kisarazu (JP); Kenichiro Miyamoto, Kitakyushu (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 284 days.

(21) Appl. No.: 15/304,540

(22) PCT Filed: Apr. 22, 2015

(86) PCT No.: PCT/JP2015/002202
§ 371 (c)(1),
(2) Date: Oct. 17, 2016

(87) PCT Pub. No.: WO2015/162928
PCT Pub. Date: Oct. 29, 2015

(65) Prior Publication Data

US 2017/0044633 A1 Feb. 16, 2017

(30) Foreign Application Priority Data

Apr. 23, 2014 (JP) ..... 2014-089420

(51) Int. Cl.

| | |
|---|---|
| ***C21D 9/02*** | (2006.01) |
| ***C21C 7/04*** | (2006.01) |
| ***C21C 7/06*** | (2006.01) |
| ***C21C 7/10*** | (2006.01) |
| ***B22D 11/00*** | (2006.01) |
| ***B22D 11/124*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/32*** | (2006.01) |
| ***C22C 38/34*** | (2006.01) |
| ***C22C 38/42*** | (2006.01) |
| ***C22C 38/46*** | (2006.01) |
| ***C22C 38/50*** | (2006.01) |
| ***C22C 38/54*** | (2006.01) |
| ***C22C 38/60*** | (2006.01) |
| ***B22D 11/115*** | (2006.01) |
| ***C22C 38/00*** | (2006.01) |

(52) U.S. Cl.

CPC ..... *C21D 9/02* (2013.01); *B22D 11/001* (2013.01); *B22D 11/115* (2013.01); *B22D 11/124* (2013.01); *C21C 7/04* (2013.01); *C21C 7/06* (2013.01); *C21C 7/10* (2013.01); *C22C 38/00* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/22* (2013.01); *C22C 38/24* (2013.01); *C22C 38/26* (2013.01); *C22C 38/28* (2013.01); *C22C 38/32* (2013.01); *C22C 38/34* (2013.01); *C22C 38/42* (2013.01); *C22C 38/46* (2013.01); *C22C 38/50* (2013.01); *C22C 38/54* (2013.01); *C22C 38/60* (2013.01)

(58) Field of Classification Search
None
See application file for complete search history.

(56) References Cited

U.S. PATENT DOCUMENTS 4,544,406 A * 10/1985 Yamamoto ..... C22C 38/04 420/106
5,415,711 A * 5/1995 Takagi ..... C22C 38/02 148/328

(Continued)

FOREIGN PATENT DOCUMENTS

EP 2163657 A1 * 3/2010
JP 05-311225 11/1993

(Continued)

OTHER PUBLICATIONS

English translation of JP 2013/255925, Dec. 2013; 24 pages.*

(Continued)

*Primary Examiner* — Helene Klemanski
(74) *Attorney, Agent, or Firm* — Clark & Brody

(57) ABSTRACT

A spring steel according to the present embodiment has a chemical composition consisting of, in mass %, C: 0.4 to 0.7%, Si: 1.1 to 3.0%, Mn: 0.3 to 1.5%, P: 0.03% or less, S: 0.05% or less, Al: 0.01 to 0.05%, rare earth metal: 0.0001 to 0.002%, N: 0.015%, O or less: 0.0030% or less, Ti: 0.02 to 0.1%, with the balance being Fe and impurities. In the spring steel, the number of oxide inclusions having an equivalent circular diameter of equal to or greater than 5 μm is equal to or less than $0.2/mm^2$, the oxide inclusions each being one of an Al-based oxide, a complex oxide containing REM, O and Al, and a complex oxysulfide containing REM, O, S, and Al. Further, a maximum value among equivalent circular diameters of the oxide inclusions is equal to or less than 40 μm.

5 Claims, 3 Drawing Sheets

(56) References Cited

U.S. PATENT DOCUMENTS

| | | | | |
|---|---|---|---|---|
| 6,120,578 | A * | 9/2000 | Nakato | C21C 7/06 148/625 |
| 6,338,763 | B1 * | 1/2002 | Hashimura | C22C 38/06 148/333 |
| 6,406,565 | B1 * | 6/2002 | Hashimura | C21D 9/02 148/330 |
| 9,732,407 | B2 * | 8/2017 | Hashimura | B22D 11/015 |
| 2006/0260719 | A1 * | 11/2006 | Mizoguchi | C21C 7/06 148/331 |
| 2009/0126834 | A1 * | 5/2009 | Sugimura | C21D 9/02 148/328 |
| 2010/0086432 | A1 * | 4/2010 | Sugimura | C21C 7/06 420/83 |
| 2016/0151832 | A1 * | 6/2016 | Miyazaki | B22D 11/001 148/548 |

FOREIGN PATENT DOCUMENTS

| | | | |
|---|---|---|---|
| JP | 09-263820 | | 10/1997 |
| JP | 11-279695 | | 10/1999 |
| JP | 2001-064753 | | 3/2001 |
| JP | 2005/002422 | A * | 1/2005 |
| JP | 2009-263704 | | 11/2009 |
| JP | 2010/236030 | A * | 10/2010 |
| JP | 2011/184705 | A * | 2/2011 |
| JP | 2013-108171 | | 6/2013 |
| JP | 2013/255925 | A * | 12/2013 |
| JP | WO2014/174587 | A1 * | 2/2017 |
| WO | WO 2008/146533 | A1 * | 12/2008 |

OTHER PUBLICATIONS

English translation of JP 2011/184705, Sep. 2011; 21 pages.*
English translation of JP 2005/002422, Jan. 2005; 9 pages.*
English translation of JP 2010/236030, Oct. 2010; 17 pages.*
English translation of JP 2013/108171, Jun. 2013; 30 pages.*
English translation of the International Search Report dated Jul. 21, 2015 for PCT/JP2015/002202; 2 pages.*
English translation of the Written Opinion of the International Search Authority dated Jul. 21, 2015 for PCT/JP2015/002202; 5 pages.*
EPO Search Report dated Aug. 17, 2017 for EP 15783239; 3 pages.*
EPO Written Opinion dated Aug. 17, 2017 for EP 15783239; 2 pages.*

* cited by examiner

SPRING STEEL AND METHOD FOR PRODUCING THE SAME

TECHNICAL FIELD

The present invention relates to a spring steel and a method for producing the same.

BACKGROUND ART

Spring steels are used in automobiles or machines in general. When a spring steel is used for an automobile suspension spring, for example, the spring steel must have high fatigue strength. Recently, there has been a need for automobiles having reduced weight and higher power output for improved fuel economy. Accordingly, spring steels that are used for engines or suspensions are required to have even higher fatigue strength.

Steel products may contain oxide inclusions typified by alumina. Coarse oxide inclusions decrease fatigue strength.

The alumina forms when the molten steel is deoxidized in the refining step. Ladles or the like often contain alumina refractory materials. For this reason, alumina may form in the molten steel not only in the case of Al deoxidation but also when deoxidation is carried out with an element other than Al (e.g., Si or Mn). Alumina in the molten steel tends to agglomerate and form clusters. In other words, alumina tends to be coarse.

Techniques for refining oxide inclusions typified by alumina are disclosed in Japanese Patent Application Publication No. 05-311225 (Patent Literature 1), Japanese Patent Application Publication No. 2009-263704 (Patent Literature 2), Japanese Patent Application Publication No. 09-263820 (Patent Literature 3), and Japanese Patent Application Publication No. 11-279695 (Patent Literature 4).

Patent Literature 1 discloses the following. A Mg alloy is added to the molten steel. As a result, the alumina is reduced and instead spinel ($MgO.Al_2O_3$) or MgO is formed. Consequently, coarsening of the alumina due to agglomeration of the alumina is inhibited.

However, the production method of Patent Literature 1 poses the possibility of nozzle clogging in a continuous casting machine. In such a case, coarse inclusions are more likely to become entrapped in the molten steel. This results in reduced fatigue strength of the steel.

Patent Literature 2 discloses the following. The average chemical composition of $SiO_2$—$Al_2O_3$—CaO oxides at a longitudinal cross-section of the steel wire rod is controlled to be $SiO_2$: 30 to 60%, $Al_2O_3$: 1 to 30%, and CaO: 10 to 50% so that the melting point of the oxides is not more than 1400° C. Furthermore, 0.1 to 10% of $B_2O_3$ is included in the oxides. As a result, the oxide inclusions are finely dispersed.

However, although $B_2O_3$ is effective for the above oxides, it sometimes cannot inhibit alumina clustering sufficiently. In such a case, the fatigue strength decreases.

Patent Literature 3 discloses the following. In the method of producing an Al-killed steel, an alloy made of two or more selected from the group consisting of Ca, Mg, and rare earth metal (REM) and Al is added to the molten steel for deoxidation.

However, in some cases, addition of the above alloy to a spring steel does not cause refinement of oxide inclusions. In such cases, the fatigue strength of the spring steel decreases.

Patent Literature 4 discloses the following. The bearing steel wire rod includes equal to or less than 0.010% of REM (0.003% in the example) so that inclusions can be spheroidized.

However, in some cases, addition of the above content of REM to a spring steel does not cause refinement of oxide inclusions. In such cases, the fatigue strength of the spring steel decreases.

Furthermore, suspension springs have the role of absorbing vibrations of the vehicle body caused by irregularities of the road surface on which it is traveling. Accordingly, suspension springs must have not only fatigue strength but also high toughness.

Methods for producing a spring include hot forming and cold forming. In cold forming, coiling is performed by cold operation to produce springs. Accordingly, spring steels must have high ductility for cold operation.

CITATION LIST

Patent Literature

Patent Literature 1: Japanese Patent Application Publication No. 05-311225

Patent Literature 2: Japanese Patent Application Publication No. 2009-263704

Patent Literature 3: Japanese Patent Application Publication No. 09-263820

Patent Literature 4: Japanese Patent Application Publication No. 11-279695

SUMMARY OF INVENTION

An object of the present invention is to provide a spring steel that exhibits excellent fatigue strength, toughness, and ductility.

A spring steel according to the present embodiment has a chemical composition consisting of, in mass %, C: 0.4 to 0.7%, Si: 1.1 to 3.0%, Mn: 0.3 to 1.5%, P: equal to or less than 0.03%, S: equal to or less than 0.05%, Al: 0.01 to 0.05%, rare earth metal: 0.0001 to 0.002%, N: equal to or less than 0.015%, O: equal to or less than 0.0030%, Ti: 0.02 to 0.1%, Ca: 0 to 0.0030%, Cr: 0 to 2.0%, Mo: 0 to 1.0%, W: 0 to 1.0%, V: 0 to 0.70%, Nb: 0 less than 0.050%, Ni: 0 to 3.5%, Cu: 0 to 0.5%, and B: 0 to 0.0050%, with the balance being Fe and impurities. In the spring steel, the number of oxide inclusions having an equivalent circular diameter of equal to or greater than 5 μm is equal to or less than $0.2/mm^2$, the oxide inclusions each being one of an Al-based oxide, a complex oxide containing REM, O and Al, and a complex oxysulfide containing REM, O, S, and Al. Furthermore, a maximum value among equivalent circular diameters of the oxide inclusions is equal to or less than 40 μm.

The spring steel according to the present embodiment exhibits excellent fatigue strength, toughness, and ductility.

DESCRIPTION OF EMBODIMENTS

Figure 1:
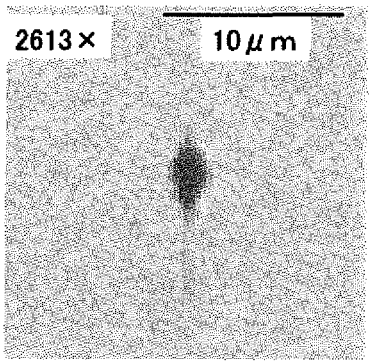
FIG. 1 is an SEM image of a complex oxysulfide containing Al, O (oxygen), REM (Ce in this embodiment), and S in a spring steel of the present embodiment.

A spring steel according to the present embodiment has a chemical composition consisting of, in mass %, C: 0.4 to 0.7%, Si: 1.1 to 3.0%, Mn: 0.3 to 1.5%, P: equal to or less than 0.03%, S: equal to or less than 0.05%, Al: 0.01 to 0.05%, rare earth metal: 0.0001 to 0.002%, N: equal to or less than 0.015%, O: equal to or less than 0.0030%, Ti: 0.02 to 0.1%, Ca: 0 to 0.0030%, Cr: 0 to 2.0%, Mo: 0 to 1.0%, W: 0 to 1.0%, V: 0 to 0.70%, Nb: 0 to less than 0.050%, Ni: 0 to 3.5%, Cu: 0 to 0.5%, and B: 0 to 0.0050%, with the balance being Fe and impurities. In the spring steel, the number of oxide inclusions having an equivalent circular diameter of equal to or greater than 5 μm is equal to or less than $0.2/mm^2$, the oxide inclusions each being one of an Al-based oxide, a complex oxide containing REM, O and Al, and a complex oxysulfide containing REM, O, S, and Al. Furthermore, a maximum value among equivalent circular diameters of the oxide inclusions is equal to or less than 40 μm.

In the spring steel according to the present embodiment, the oxide inclusions, each of which is one of an Al-based oxide, a complex oxide (inclusion containing REM and containing Al and O), and a complex oxysulfide (inclusion containing REM and containing Al, O, and S), are finely dispersed. As a result, the spring steel has high fatigue strength. Furthermore, the spring steel of the present embodiment includes Ti and therefore has high toughness. As a result, the spring steel according to the present embodiment exhibits excellent ductility.

The chemical composition of the above spring steel may include Ca: 0.0001 to 0.0030%. The chemical composition of the above spring steel may include one or more selected from the group consisting of, Cr: 0.05 to 2.0%, Mo: 0.05 to 1.0%, W: 0.05 to 1.0%, V: 0.05 to 0.70%, Nb: 0.002 to less than 0.050%, Ni: 0.1 to 3.5%, Cu: 0.1 to 0.5%, and B: 0.0003 to 0.0050%.

A method for producing the spring steel of the present embodiment includes the steps of: refining molten steel having the above chemical composition; producing a semi-finished product using the refined molten steel by a continuous casting process; and hot working the semi-finished product. The step of refining molten steel includes: a step of deoxidizing the molten steel using Al during ladle refining; and a step of deoxidizing the molten steel using REM for at least 5 minutes after the deoxidation with Al. The step of producing a semi-finished product includes: a step of stirring the molten steel within a mold to swirl the molten steel in a horizontal direction at a flow velocity of 0.1 m/min or faster; and a step of cooling the semi-finished product being cast at a cooling rate of 1 to 100° C./min.

In the refining step, Al deoxidation and REM deoxidation are performed in this order during the ladle refining with the REM deoxidation being performed for at least 5 minutes. Then, in the continuous casting step, swirling is performed at the aforementioned flow velocity and cooling is performed at the aforementioned cooling rate. With this production method, it is possible to produce a spring steel that satisfies the number of coarse oxide inclusions and the maximum value among equivalent circular diameters of the coarse oxide inclusions mentioned above.

The spring steel of the present embodiment will be described in detail below. In the contents of the elements, "%" means "% by mass".

[Chemical Composition]

The chemical composition of the spring steel according to the present embodiment includes the following elements.

C: 0.4 to 0.7%

Carbon (C) increases the strength of the steel. If the C content is too low, this advantageous effect cannot be produced. On the other hand, if the C content is too high, pro-eutectoid cementites will form excessively in the cooling process after hot rolling. In such a case, the workability for wire drawing of the steel decreases. Accordingly, the C content ranges from 0.4 to 0.7%. The lower limit of the C content is preferably greater than 0.4%, more preferably 0.45%, and even more preferably 0.5%. The upper limit of the C content is preferably less than 0.7%, more preferably 0.65%, and even more preferably 0.6%.

Si: 1.1 to 3.0%

Silicon (Si) increases the hardenability of the steel and increases the fatigue strength of the steel. In addition, Si increases sag resistance. If the Si content is too low, these advantageous effects cannot be produced. On the other hand, if the Si content is too high, the ductility of ferrite in pearlite will decrease. In addition, if the Si content is too high, decarbonization will be promoted in the processes of rolling, quenching, and tempering, resulting in a decrease in the strength of the steel. Accordingly, the Si content ranges from 1.1 to 3.0%. The lower limit of the Si content is preferably greater than 1.1%, more preferably 1.2%, and even more preferably 1.3%. The upper limit of the Si content is preferably less than 3.0%, more preferably 2.5%, and even more preferably 2.0%.

Mn: 0.3 to 1.5%

Manganese (Mn) deoxidizes the steel. In addition, Mn increases the strength of the steel. If the Mn content is too low, these advantageous effects cannot be produced. On the other hand, if the Mn content is too high, segregation will occur. In the segregation portion, micromartensite will form. The micromartensite will be a factor that causes flaws in the rolling process. Furthermore, the micromartensite decreases the workability for wire drawing of the steel. Accordingly, the Mn content ranges from 0.3 to 1.5%. The lower limit of the Mn content is preferably greater than 0.3%, more preferably 0.4%, and even more preferably 0.5%. The upper limit of the Mn content is preferably less than 1.5%, more preferably 1.4%, and even more preferably 1.2%.

P: Equal to or Less than 0.03%

Phosphorus (P) is an impurity. P segregates at the grain boundaries, which results in a decrease in the fatigue strength of the steel. Accordingly, the P content is preferably as low as possible. The P content is equal to or less than 0.03%. The upper limit of the P content is preferably less than 0.03%, and more preferably 0.02%.

S: Equal to or Less than 0.05%

Sulfur (S) is an impurity. S forms coarse MnS, which results in a decrease in the fatigue strength of the steel. Accordingly, the S content is preferably as low as possible. The S content is equal to or less than 0.05%. The upper limit of the S content is preferably less than 0.05%, more preferably 0.03%, and even more preferably 0.01%.

Al: 0.01 to 0.05%

Aluminum (Al) deoxidizes the steel. In addition, Al adjusts the grains of the steel. If the Al content is too low, these advantageous effects cannot be produced. On the other hand, if the Al content is too high, the above advantageous effects will reach saturation. In addition, if the Al content is too high, large amounts of alumina will remain. Accordingly, the Al content ranges from 0.01 to 0.05%. The lower limit of the Al content is preferably greater than 0.01%. The upper limit of the Al content is preferably less than 0.05%, and more preferably 0.035%. The Al content as referred to in this specification means the content of the so-called total Al.

REM: 0.0001 to 0.002%

Rare earth metal (REM) desulfurizes and deoxidizes the steel. In addition, REM bonds with Al-based oxides to refine oxide inclusions. This is described below.

In this specification, the oxide inclusions are one or more of Al-based oxides typified by alumina, complex oxides, and complex oxysulfides. The Al-based oxide, complex oxide, and complex oxysulfide are defined as follows.

The Al-based oxide includes at least 30% of O (oxygen) and at least 5% of Al. The Al-based oxide may further include at least one or more deoxidizing elements such as Mn, Si, Ca, and Mg. The REM content in the Al-based oxide is less than 1%.

The complex oxide includes at least 30% of O (oxygen), at least 5% of Al, and at least 1% of REM. The complex oxide may further include at least one or more deoxidizing elements such as Mn, Si, Ca, and Mg.

The complex oxysulfide includes at least 30% of O (oxygen), at least 5% of Al, at least 1% of REM, and S. The complex oxysulfide may further include at least one or more deoxidizing elements such as Mn, Si, Ca, and Mg.

The REM reacts with Al-based oxides in the steel to form complex oxides. The complex oxides may further react with S to form complex oxysulfides. Thus, the REM transforms Al-based oxides into complex oxides or complex oxysulfides. This inhibits the Al-based oxides from agglomerating in the molten steel to form clusters, thereby making it possible to disperse fine oxide inclusions in the steel.

FIG. 1 is an SEM image illustrating an example of a complex oxysulfide in the spring steel of the present embodiment. The equivalent circular diameter of the complex oxysulfide in FIG. 1 is less than 5 μM. The chemical composition of the complex oxysulfide in FIG. 1 includes 64.4% of O (oxygen), 18.4% of Al, 5.5% of Mn, 4.6% of S, and 3.8% of Ce (REM).

The complex oxides and complex oxysulfides, which are represented by FIG. 1, have equivalent circular diameters of about 1 to 5 μm and therefore are fine. In addition, neither the complex oxides nor complex oxysulfides are extended to become coarse or form clusters. Thus, neither the complex oxides nor complex oxysulfides are likely to act as initiation points for fatigue fracture. As a result, the fatigue strength of the spring steel increases.

The spring steel of the present embodiment preferably includes at least the complex oxysulfides of all the oxide inclusions. In this case, S is immobilized in the complex oxysulfides. As a result, precipitation of MnS is inhibited and precipitation of TiS at the grain boundaries is also inhibited. Consequently, the ductility of the spring steel increases.

If the REM content is too low, these advantageous effects cannot be produced. On the other hand, if the REM content is too high, the inclusions containing REM may clog the nozzle in continuous casting. Even in the case where the inclusions containing REM do not clog the nozzle, the coarse inclusions containing REM are included in the steel, which results in a decrease in the fatigue strength of the steel. Accordingly, the REM content ranges from 0.0001 to 0.002%. The lower limit of the REM content is preferably greater than 0.0001%, more preferably 0.0002%, and even more preferably greater than 0.0003%. The upper limit of the REM content is preferably less than 0.002%, more preferably 0.0015%, still more preferably 0.0010%, and even more preferably 0.0005%.

The REM as referred to in this specification is a generic term for lanthanides from lanthanum (La) with atomic number 57 through lutetium (Lu) with atomic number 71, scandium (Sc) with atomic number 21, and yttrium (Y) with atomic number 39.

N: Equal to or Less than 0.015%

Nitrogen (N) is an impurity. N forms nitrides, which results in a decrease in the fatigue strength of the steel. In addition, N causes strain aging, which results in a decrease in the ductility and toughness of the steel. Accordingly, the N content is preferably as low as possible. The N content is equal to or less than 0.015%. The upper limit of the N content is preferably less than 0.015%, more preferably 0.010%, still more preferably 0.008%, and even more preferably 0.006%.

O: Equal to or Less than 0.0030%

Oxygen (O) is an impurity. O forms Al-based oxides, complex oxides, and complex oxysulfides. If the O content is too high, large amounts of coarse Al-based oxides will form, which will shorten the fatigue lifetime of the steel. Accordingly, the O content is equal to or less than 0.0030%. The upper limit of the O content is preferably less than 0.0030%, more preferably 0.0020%, and even more preferably 0.0015%. The O content as referred to in this specification is the so-called total oxygen amount (T. O).

Ti: 0.02 to 0.1%

Titanium (Ti) forms fine Ti carbides and Ti carbonitrides in the austenite temperature range above the $A_3$ temperature. During heating for quenching, the Ti carbides and Ti carbonitrides exert the pinning effect on the austenite grains to refine the grains and make them uniform. Thus, Ti increases the toughness of the steel.

In general, when Ti is included, Ti carbides and Ti carbonitrides form and further TiS precipitates at the grain boundaries. TiS decreases the ductility of steel similarly to MnS.

However, as described above, in the spring steel of the present embodiment, S bonds with REM to form complex oxysulfides. As a result, S does not segregate at the grain boundaries and therefore neither TiS nor MnS are likely to form. Thus, in the present embodiment, the contained Ti increases the toughness and also provides high ductility. If the Ti content is too low, these advantageous effects cannot be produced.

On the other hand, if the Ti content is too high, coarse TiN will form. TiN tends to be a fracture initiation point and also be a hydrogen trapping site. As a result, the fatigue strength of the steel will decrease. Accordingly, the Ti content ranges from 0.02 to 0.1%. The lower limit of the Ti content is preferably greater than 0.02%, and more preferably 0.04%. The upper limit of the Ti content is preferably less than 0.1%, more preferably 0.08%, and even more preferably 0.06%.

The balance of the chemical composition of the spring steel according to the present embodiment is Fe and impurities. The impurities herein refer to impurities that find their way into the steel from ores and scrap as raw materials or from the production environment, for example, when a steel product is industrially produced and which are allowed within a range that does not adversely affect the advantageous effects of the spring steel of the present embodiment.

The chemical composition of the spring steel according to the present embodiment may further include Ca in place of part of Fe.

Ca: 0 to 0.0030%

Calcium (Ca) is an optional element and may not be included. When Ca is included, the Ca desulfurizes the steel. On the other hand, if the Ca content is too high, coarse, low melting point Al—Ca—O oxides will form. In addition, if the Ca content is too high, complex oxysulfides will absorb Ca. Complex oxysulfides that have absorbed Ca tend to become coarse. Such coarse oxides tend to be fracture initiation points for steels. Accordingly, the Ca content ranges from 0 to 0.0030%. The lower limit of the Ca content is preferably not less than 0.0001%, more preferably 0.0003%, and even more preferably 0.0005%. The upper limit of the Ca content is preferably less than 0.0030%, more preferably 0.0020%, and even more preferably 0.0015%.

The chemical composition of the spring steel according to the present embodiment may further include, in place of part of Fe, one or more selected from the group consisting of, Cr, Mo, W, V, Nb, Ni, Cu, and B. All of these elements increase the strength of the steel.

Cr: 0 to 2.0%

Chromium (Cr) is an optional element and may not be included. When included, the Cr increases the strength of the steel. In addition, Cr increases the hardenability of the steel and increases the fatigue strength of the steel. In addition, Cr increases the temper softening resistance. On the other hand, if the Cr content is too high, the hardness of the steel increases excessively, which results in a decrease in ductility. Accordingly, the Cr content ranges from 0 to 2.0%. The lower limit of the Cr content is preferably 0.05%. When the temper softening resistance is to be increased, the lower limit of the Cr content is preferably 0.5%, and more preferably 0.7%. The upper limit of the Cr content is preferably less than 2.0%. When the spring steel product is to be produced through cold coiling, the upper limit of the Cr content is more preferably 1.5%.

Mo: 0 to 1.0%

Molybdenum (Mo) is an optional element and may not be included. When included, the Mo increases the hardenability of the steel and increases the strength of the steel. In addition, Mo increases the temper softening resistance of the steel. In addition, Mo forms fine carbides to refine the grains. Mo carbides precipitate at lower temperatures than vanadium carbides. Thus, Mo is effective in refining the grains of high strength spring steels, which are tempered at low temperatures.

On the other hand, if the Mo content is too high, a supercooled structure tends to form in the cooling process after hot rolling. Supercooled structures can be a cause of season cracking or cracking during working. Accordingly, the Mo content ranges from 0 to 1.0%. The lower limit of the Mo content is preferably 0.05%, and more preferably 0.10%. The upper limit of the Mo content is preferably less than 1.0%, more preferably 0.75%, and even more preferably 0.50%.

W: 0 to 1.0%

Tungsten (W) is an optional element and may not be included. When included, the W increases the hardenability of the steel and increases the strength of the steel similarly to Mo. In addition, W increases the temper softening resistance of the steel. On the other hand, if the W content is too high, a supercooled structure will form as with Mo. Accordingly, the W content ranges from 0 to 1.0%. When high temper softening resistance is to be obtained, the lower limit of the W content is preferably 0.05%, and more preferably 0.1%. The upper limit of the W content is preferably less than 1.0%, more preferably 0.75%, and even more preferably 0.50%.

V: 0 to 0.70%

Vanadium (V) is an optional element and may not be included. When included, the V forms fine nitrides, carbides, and carbonitrides. These precipitates increase the temper softening resistance of the steel and the strength of the steel. In addition, these precipitates refine the grains. On the other hand, if the V content is too high, the V nitrides, V carbides, and V carbonitrides will not dissolve sufficiently when heated for quenching. Undissolved V nitrides, V carbides, and V carbonitrides become coarse and remain in the steel, which results in a decrease in the ductility and fatigue strength of the steel. In addition, if the V content is too high, a supercooled structure will form. Accordingly, the V content ranges from 0 to 0.70%. The lower limit of the V content is preferably 0.05%, more preferably 0.06%, and even more preferably 0.08%. The upper limit of the V content is preferably less than 0.70%, more preferably 0.50%, still more preferably 0.30%, and most preferably the upper limit is 0.25%.

Nb: 0 to less than 0.050%

Niobium (Nb) is an optional element and may not be included. When included, similarly to V, the Nb forms nitrides, carbides, and carbonitrides, which increases the strength and temper softening resistance of the steel and refines the grains. On the other hand, if the Nb content is too high, the ductility of the steel will decrease. Accordingly, the Nb content ranges from 0 to less than 0.050%. The lower limit of the Nb content is preferably 0.002%, more preferably 0.005%, and even more preferably 0.008%. When springs are to be produced through cold coiling, the upper limit of the Nb content is preferably less than 0.030%, and more preferably less than 0.020%.

Ni: 0 to 3.5%

Nickel (Ni) is an optional element and may not be included. When included, the Ni increases the strength and hardenability of the steel similarly to Mo. In addition, when Cu is included, the Ni forms an alloy phase with the Cu to inhibit the decrease in hot workability of the steel. On the other hand, if the Ni content is too high, the amount of retained austenite will increase excessively, which results in a decrease in the strength of the steel after quenching. In addition, the retained austenite will transform into martensite in use to cause swelling. As a result, the dimensional accuracy of the product decreases. Accordingly, the Ni content ranges from 0 to 3.5%. The lower limit of the Ni content is preferably 0.1%, more preferably 0.2%, and even more preferably 0.3%. The upper limit of the Ni content is preferably less than 3.5%, more preferably 2.5%, and even more preferably 1.0%. When Cu is included, the Ni content is preferably not less than the Cu content.

Cu: 0 to 0.5%

Copper (Cu) is an optional element and may not be included. When included, the Cu increases the hardenability of the steel and increases the strength of the steel. In addition, Cu increases the corrosion resistance of the steel and inhibits decarburization of the steel. On the other hand, if the Cu content is too high, the hot workability decreases. In such a case, flaws tend to occur in the production processes such as casting, rolling, and forging. Accordingly, the Cu content ranges from 0 to 0.5%. The lower limit of the Cu content is preferably 0.1%, and more preferably 0.2%. The upper limit of the Cu content is preferably less than 0.5%, more preferably 0.4%, and even more preferably 0.3%.

B: 0 to 0.0050%

Boron (13) is an optional element and may not be included. When included, the B increases the hardenability of the steel and increases the strength of the steel.

In addition, B is held in solid solution in the steel to segregate at the grain boundaries. The solute B inhibits grain boundary segregation of grain boundary embrittling elements such as P, N, and S. Thus, B strengthens grain boundaries. In the spring steel of the present embodiment, S segregation at grain boundaries is significantly inhibited when B is included together with Ti and REM. As a result, the fatigue strength and toughness of the steel increase.

On the other hand, if the B content is too high, a supercooled structure such as martensite or bainite will form. Accordingly, the B content ranges from 0 to 0.0050%. The lower limit of the B content is preferably not less than 0.0003%, more preferably 0.0005%, and even more preferably 0.0008%. The upper limit of the B content is preferably less than 0.0050%, more preferably 0.0030%, and even more preferably 0.0020%.

[Microstructure]

[Number TN of Coarse Oxide Inclusions]

In the spring steel having the above-described chemical composition, the number TN of oxide inclusions having an equivalent circular diameter of equal to or greater than 5 μm is equal to or less than 0.2/mm$^2$, the oxide inclusions each being one of an Al-based oxide, a complex oxide, and a complex oxysulfide.

The equivalent circular diameter refers to the diameter of a circle determined to have the same area as the area of each of the oxide inclusions (Al-based oxides, complex oxides, and complex oxysulfides). Hereinafter, oxide inclusions having an equivalent circular diameter of equal to or greater than 5 μm are designated as "coarse oxide inclusions". The number TN of the coarse oxide inclusions may be determined in the following manner.

A rod-shaped or line-shaped spring steel is cut along the axial direction. The cross section is mirror polished. Selective Potentiostatic Etching by Electrolytic Dissolution (SPEED method) is performed on the polished cross section. On the etched cross section, five fields are freely selected which are rectangular regions with a 2 mm width in a radial direction and a 5 mm length in an axial direction, with a location R/2 deep from the surface of the spring steel (R is the radius of the spring steel) being the center.

Using a scanning electron microscope (SEM) equipped with an energy dispersive X-ray microanalyzer (EDX), the fields are each observed at a magnification of 2000× and images of the fields are acquired. Inclusions in the fields are identified. Using the EDX, the chemical composition (Al content, O content, REM content, S content, etc. in the inclusion) of each of the identified inclusions is analyzed. Based on the analysis results, oxide inclusions (Al-based oxides, complex oxides, and complex oxysulfides) are identified among the inclusions.

The equivalent circular diameters of the identified oxide inclusions (Al-based oxides, complex oxides, and complex oxysulfides) are determined by image processing to identify oxide inclusions having an equivalent circular diameter of equal to or greater than 5 μm (coarse oxide inclusions).

The total number of the coarse oxide inclusions in the five fields is determined and the number TN (number/mm$^2$) of the coarse oxide inclusions is determined by the following formula.

$$TN = \text{Total number of coarse oxide inclusions in five fields/Total area of five fields}$$

In the spring steel of the present embodiment, the number TN of coarse oxide inclusions is not greater than 0.2/mm$^2$. The appropriate amount of REM contained under appropriate production conditions transforms Al-based oxides into fine complex oxides or complex oxysulfides. This results in achieving the low number TN. Consequently, high fatigue strength is obtained.

[Maximum Value Dmax Among Equivalent Circular Diameters of Oxide Inclusions]

Furthermore, in the spring steel of the present embodiment, the maximum value Dmax among equivalent circular diameters of the oxide inclusions is equal to or less than 40 μm.

The maximum value Dmax is determined in the following manner. When measuring the number TN described above, the equivalent circular diameters of the oxide inclusions in the five fields are determined. The maximum value among the determined equivalent circular diameters is designated as the maximum value Dmax among equivalent circular diameters of the oxide inclusions.

In the spring steel of the present embodiment, the maximum value Dmax is not greater than 40 μm. The appropriate amount of REM contained therein transforms Al-based oxides into fine complex oxides or complex oxysulfides to thereby achieve the low maximum value Dmax. Consequently, high fatigue strength is obtained.

[Production Method]

An exemplary method for producing the above spring steel is described. The method for producing the spring steel of the present embodiment includes: a step of refining molten steel (refining process); a step of producing a semi-finished product using the refined molten steel by a continuous casting process (casting process); a step of hot working the semi-finished product to produce the spring steel (hot working process).

[Refining Process]

In the refining process, molten steel is refined. First, molten steel is subjected to ladle refining. Any known ladle refining may be employed as the ladle refining. Examples of ladle refining include a vacuum degassing process using RH (Ruhrstahl-Heraeus).

While ladle refining is being performed, Al is introduced into the molten steel to Al-deoxidize the molten steel. Preferably, the O content (total oxygen amount) in the molten steel after Al deoxidation is not greater than 0.0030%.

After the Al deoxidation, REM is introduced into the molten steel to perform deoxidation by REM deoxidation for at least 5 minutes.

After the REM deoxidation, ladle refining including a vacuum degassing process may further be performed. With the refining step described above, molten steel having the above chemical composition is produced.

In the refining process described above, the REM deoxidation is performed after the Al deoxidation for at least 5 minutes. This results in transformation of the Al-based oxides into complex oxides or complex oxysulfides and refinement thereof. Consequently, coarsening (clustering) of Al-based oxides as in the conventional art is inhibited.

If the REM deoxidation lasts for less than 5 minutes, the transformation of Al-based oxides into complex oxides or complex oxysulfides will be insufficient. Consequently, the number TN will exceed 0.2/mm$^2$ and/or the maximum value Dmax among equivalent circular diameters of the oxide inclusions will exceed 40 μm.

In addition, if deoxidation is carried out with an element other than Al before the REM deoxidation, the transformation of Al-based oxides into complex oxides or complex oxysulfides will be insufficient. Consequently, the number TN will exceed 0.2/mm$^2$ and/or the maximum value Dmax among equivalent circular diameters of the oxide inclusions will exceed 40 μm.

For the REM deoxidation, for example, a misch metal (mixture of REM's) may be used. In such a case, a lump-like misch metal may be added to the molten steel. At the last stage of the refining, a Ca—Si alloy, CaO—$CaF_2$ flux, or another substance may be added to the molten steel to carry out desulfurization.

[Casting Process]

Using the ladle-refined molten steel, a semi-finished product is produced by a continuous casting process.

Even after the ladle refining, the REM and Al-based oxides react with each other in the molten steel to form complex oxysulfides and complex oxides. Therefore, by swirling the molten steel within the mold, the reaction between REM and Al-based oxides can be facilitated.

Accordingly, in the casting process, the molten steel within the mold is stirred and swirled in the horizontal direction at a flow velocity of 0.1 m/min or faster. This promotes the reaction between REM and Al-based oxides to form complex oxides and complex oxysulfides. As a result, the number TN of coarse oxide inclusions is not greater than $0.2/mm^2$ and the maximum value Dmax of the oxide inclusions is not greater than 40 μm. On the other hand, if the flow velocity is less than 0.1 m/min, the reaction between REM and Al-based oxides is less likely to be promoted. Consequently, the number TN will exceed $0.2/mm^2$ and/or the maximum value Dmax will exceed 40 μm. Stirring of the molten steel is carried out by electromagnetic stirring, for example.

In addition, the cooling rate RC of the semi-finished product being cast affects the coarsening of oxide inclusions. In the present embodiment, the cooling rate RC ranges from 1 to 100° C./min. The cooling rate refers to a rate of cooling from the liquidus temperature to the solidus temperature at a location T/4 deep (T is the thickness of the semi-finished product) from the upper or lower surface of the semi-finished product. If the cooling rate is too low, the coarsening of oxide inclusions is more likely to occur. Thus, if the cooling rate RC is less than 1° C./min, the number TN of coarse oxide inclusions will exceed $0.2/mm^2$ and/or the maximum value Dmax among equivalent circular diameters of the oxide inclusions will exceed 40 μm.

On the other hand, if the cooling rate RC is greater than 100° C./min, coarse oxide inclusions will be trapped in the steel before floating during casting. Consequently, the number TN of coarse oxide inclusions will exceed $0.2/mm^2$ and/or the maximum value Dmax among equivalent circular diameters of the oxide inclusions will exceed 40 μm.

When the cooling rate RC ranges from 1 to 100° C./min, the number TN of coarse oxide inclusions is not greater than $0.2/mm^2$ and the maximum value Dmax among equivalent circular diameters of the oxide inclusions is not greater than 40 μm.

Figure 2:
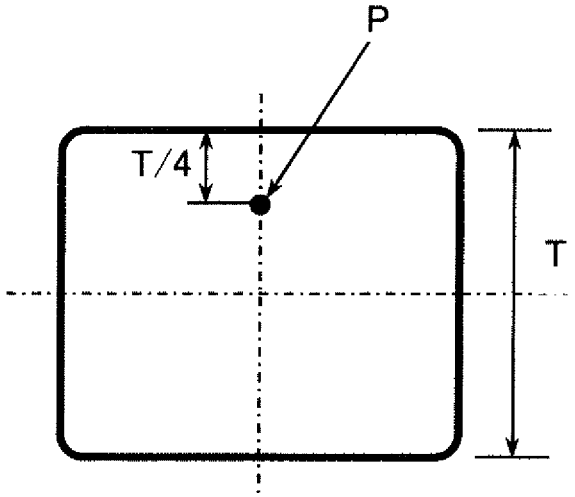
FIG. 2 is a transverse cross-sectional view of a semi-finished product for illustrating a method for measuring the cooling rate of the semi-finished product in a casting step.

The cooling rate may be determined in the following manner. FIG. 2 illustrates a transverse cross section (cross section perpendicular to the axial direction of the semi-finished product) of the cast semi-finished product. Referring to FIG. 2, in the transverse cross section of the semi-finished product, any point P that is T/4 deep from the upper or lower surface of the semi-finished product at the time of casting is selected. T is the thickness (mm) of the semi-finished product. In the solidified structure at point P, the secondary dendrite arm spacing λ (μm) in the thickness T direction is measured. Specifically, the secondary dendrite arm spacing in the thickness T direction is measured at 10 locations and the average of the measurements is designated as the spacing λ.

The determined spacing λ is substituted into Formula (1) to determine the cooling rate RC (° C./min).

$$RC=(\lambda/770)^{-(1/0.41)} \quad (1)$$

The lower limit of the cooling rate RC is preferably 5° C./min. The upper limit of the cooling rate RC is preferably less than 60° C./min and more preferably less than 30° C./min. Under the production conditions described above, the semi-finished product is produced.

[Hot Working Process]

The produced semi-finished product is subjected to hot working to produce a wire rod. For example, the semi-finished product is subjected to billeting to produce a billet. The billet is subjected to hot rolling to produce a wire rod. Using the production method described above, the wire rod is produced.

When springs are produced using the wire rod, either a hot forming process or a cold forming process may be used. The hot forming process may be implemented as follows, for example. The wire rod is subjected to wire drawing to obtain a spring steel wire. The spring steel wire is heated to above the $A_3$ temperature. The heated spring steel wire (austenite structure) is wound around a mandrel to be formed into a coil (spring). The formed spring is subjected to quenching and tempering to adjust the strength of the spring. The quenching temperature ranges from 850 to 950° C., for example, with oil cooling being performed. The tempering temperature ranges from 420 to 500° C., for example. Using the steps described above, springs are produced.

The cold forming process is implemented as follows. The wire rod is subjected to wire drawing to obtain a spring steel wire. The spring steel wire is subjected to quenching and tempering to produce a strength-adjusted steel wire. The quenching temperature ranges from 850 to 950° C., for example, and the tempering temperature ranges from 420 to 500° C., for example. Cold coil forming is carried out using a cold coiling machine to produce springs.

The spring steel according to the present embodiment has excellent fatigue strength as well as excellent toughness and ductility. Thus, even when a cold forming process is employed to form springs, plastic deformation of the spring steel is readily accomplished without breaking off during forming.

EXAMPLES

Ladle refining was carried out to produce molten steels having chemical compositions shown in Tables 1 and 2.

TABLE 1

| | Chemical composition (in mass %, balance is Fe and impurities) | | | | | | | | | |
|---|---|---|---|---|---|---|---|---|---|---|
| Test No. | C | Si | Mn | P | S | T.Al | REM | T.N | T.O | Ti |
| 1 | 0.56 | 1.65 | 1.07 | 0.006 | 0.005 | 0.022 | 0.0004 | 0.0069 | 0.0008 | 0.047 |
| 2 | 0.46 | 2.16 | 0.88 | 0.009 | 0.006 | 0.017 | 0.0004 | 0.0044 | 0.0012 | 0.033 |
| 3 | 0.48 | 1.64 | 0.74 | 0.008 | 0.006 | 0.019 | 0.0005 | 0.0057 | 0.0012 | 0.048 |
| 4 | 0.56 | 2.23 | 0.88 | 0.008 | 0.005 | 0.025 | 0.0002 | 0.0063 | 0.0015 | 0.059 |
| 5 | 0.56 | 2.07 | 0.91 | 0.009 | 0.007 | 0.025 | 0.0002 | 0.0061 | 0.0008 | 0.062 |
| 6 | 0.54 | 1.49 | 0.87 | 0.010 | 0.003 | 0.025 | 0.0001 | 0.0069 | 0.0015 | 0.051 |
| 7 | 0.57 | 2.28 | 1.02 | 0.011 | 0.004 | 0.024 | 0.0006 | 0.0076 | 0.0006 | 0.058 |
| 8 | 0.57 | 1.92 | 1.00 | 0.008 | 0.004 | 0.025 | 0.0009 | 0.0078 | 0.0013 | 0.078 |

TABLE 1-continued

| Test No. | Chemical composition (in mass %, balance is Fe and impurities) | | | | | | | | | |
|---|---|---|---|---|---|---|---|---|---|---|
| | C | Si | Mn | P | S | T.Al | REM | T.N | T.O | Ti |
| 9 | 0.56 | 1.83 | 1.09 | 0.011 | 0.010 | 0.029 | 0.0006 | 0.0041 | 0.0009 | 0.076 |
| 10 | 0.54 | 2.10 | 0.68 | 0.006 | 0.005 | 0.030 | 0.0007 | 0.0051 | 0.0012 | 0.022 |
| 11 | 0.56 | 1.68 | 1.00 | 0.012 | 0.005 | 0.023 | 0.0005 | 0.0080 | 0.0011 | 0.044 |
| 12 | 0.56 | 1.47 | 0.75 | 0.012 | 0.004 | 0.029 | 0.0006 | 0.0042 | 0.0009 | 0.034 |
| 13 | 0.57 | 2.12 | 0.96 | 0.011 | 0.010 | 0.026 | 0.0008 | 0.0066 | 0.0011 | 0.052 |
| 14 | 0.56 | 1.75 | 0.87 | 0.009 | 0.010 | 0.037 | 0.0004 | 0.0065 | 0.0013 | 0.023 |
| 15 | 0.56 | 2.46 | 1.05 | 0.012 | 0.006 | 0.030 | 0.0002 | 0.0045 | 0.0012 | 0.042 |
| 16 | 0.58 | 2.00 | 0.68 | 0.006 | 0.006 | 0.036 | 0.0008 | 0.0073 | 0.0009 | 0.069 |
| 17 | 0.56 | 1.62 | 1.03 | 0.007 | 0.004 | 0.019 | 0.0003 | 0.0056 | 0.0009 | 0.039 |
| 18 | 0.56 | 2.21 | 1.09 | 0.011 | 0.008 | 0.032 | 0.0002 | 0.0071 | 0.0013 | 0.054 |
| 19 | 0.55 | 2.09 | 1.13 | 0.005 | 0.009 | 0.038 | 0.0003 | 0.0076 | 0.0009 | 0.048 |
| 20 | 0.53 | 2.27 | 0.92 | 0.006 | 0.009 | 0.033 | 0.0006 | 0.0064 | 0.0014 | 0.026 |
| 21 | 0.56 | 2.26 | 0.92 | 0.010 | 0.005 | 0.024 | 0.0006 | 0.0043 | 0.0008 | 0.033 |
| 22 | 0.56 | 2.11 | 1.08 | 0.007 | 0.008 | 0.037 | 0.0005 | 0.0077 | 0.0014 | 0.074 |
| 23 | 0.55 | 1.51 | 0.80 | 0.009 | 0.009 | 0.024 | 0.0002 | 0.0060 | 0.0012 | 0.064 |
| 24 | 0.55 | 2.13 | 0.73 | 0.006 | 0.004 | 0.033 | 0.0005 | 0.0067 | 0.0006 | 0.040 |
| 25 | 0.53 | 2.14 | 0.92 | 0.008 | 0.007 | 0.038 | 0.0008 | 0.0060 | 0.0014 | 0.040 |
| 26 | 0.57 | 2.08 | 0.67 | 0.011 | 0.003 | 0.028 | 0.0002 | 0.0043 | 0.0010 | 0.038 |
| 27 | 0.53 | 1.41 | 0.78 | 0.006 | 0.006 | 0.031 | 0.0002 | 0.0044 | 0.0006 | 0.045 |
| 28 | 0.55 | 1.86 | 1.00 | 0.008 | 0.007 | 0.027 | 0.0003 | 0.0066 | 0.0014 | 0.076 |
| 29 | 0.55 | 1.71 | 0.84 | 0.009 | 0.009 | 0.034 | 0.0004 | 0.0070 | 0.0008 | 0.035 |
| 30 | 0.54 | 1.31 | 1.06 | 0.007 | 0.003 | 0.026 | 0.0004 | 0.0042 | 0.0009 | 0.030 |
| 31 | 0.57 | 2.07 | 0.66 | 0.008 | 0.008 | 0.032 | 0.0007 | 0.0059 | 0.0014 | 0.023 |
| 32 | 0.58 | 1.88 | 0.95 | 0.007 | 0.007 | 0.039 | 0.0005 | 0.0075 | 0.0012 | 0.044 |
| 33 | 0.53 | 2.25 | 0.69 | 0.009 | 0.007 | 0.039 | — | 0.0055 | 0.0006 | — |
| 34 | 0.46 | 1.69 | 0.68 | 0.009 | 0.009 | 0.022 | 0.0008 | 0.0054 | 0.0033 | 0.034 |
| 35 | 0.57 | 2.28 | 1.05 | 0.007 | 0.007 | 0.040 | 0.0004 | 0.0053 | 0.0009 | 0.058 |
| 36 | 0.46 | 1.50 | 0.70 | 0.007 | 0.007 | 0.019 | 0.0004 | 0.0070 | 0.0013 | 0.044 |
| 37 | 0.58 | 1.45 | 0.79 | 0.007 | 0.007 | 0.031 | 0.0260 | 0.0077 | 0.0007 | 0.027 |
| 38 | 0.49 | 1.67 | 0.84 | 0.005 | 0.007 | 0.027 | 0.0048 | 0.0074 | 0.0014 | 0.035 |
| 39 | 0.44 | 1.60 | 0.68 | 0.006 | 0.008 | 0.034 | 0.00006 | 0.0075 | 0.0012 | 0.060 |
| 40 | 0.48 | 1.53 | 0.75 | 0.011 | 0.008 | 0.028 | 0.0006 | 0.0120 | 0.0006 | 0.170 |
| 41 | 0.55 | 1.96 | 0.73 | 0.009 | 0.007 | 0.025 | 0.0016 | 0.0043 | 0.0012 | 0.189 |
| 42 | 0.55 | 1.49 | 0.79 | 0.012 | 0.010 | 0.024 | 0.0014 | 0.0079 | 0.0013 | 0.026 |
| 43 | 0.57 | 1.94 | 0.70 | 0.009 | 0.003 | 0.030 | 0.0003 | 0.0050 | 0.0010 | 0.052 |
| 44 | 0.53 | 1.89 | 0.75 | 0.008 | 0.009 | 0.023 | — | 0.0046 | 0.0010 | 0.048 |
| 45 | 0.56 | 1.74 | 0.77 | 0.007 | 0.010 | 0.029 | — | 0.0055 | 0.0010 | 0.002 |
| 46 | 0.54 | 1.78 | 0.75 | 0.007 | 0.009 | 0.027 | — | 0.0045 | 0.0010 | 0.025 |
| 47 | 0.58 | 1.64 | 0.79 | 0.006 | 0.008 | 0.030 | 0.0008 | 0.0077 | 0.0017 | 0.003 |

TABLE 2

| Test No. | Chemical composition (continuation of Table 1, in mass %, balance is Fe and impurities) | | | | | | | | |
|---|---|---|---|---|---|---|---|---|---|
| | Ca | Cr | Mo | W | V | Nb | Ni | Cu | B |
| 1 | — | 0.60 | — | — | — | — | — | — | — |
| 2 | — | 0.70 | — | — | — | — | — | — | — |
| 3 | — | 1.20 | — | — | — | — | — | — | — |
| 4 | — | 0.62 | — | — | — | — | — | — | — |
| 5 | — | 0.61 | — | — | — | — | — | — | 0.0029 |
| 6 | — | 0.63 | — | — | — | — | — | — | 0.0019 |
| 7 | — | 0.72 | — | — | — | — | — | — | 0.0030 |
| 8 | — | 0.81 | — | — | 0.08 | — | 0.24 | — | 0.0010 |
| 9 | — | 0.71 | — | — | 0.14 | — | — | — | 0.0008 |
| 10 | — | 0.12 | 0.05 | — | 0.12 | — | — | — | 0.0013 |
| 11 | — | 1.00 | — | — | — | — | — | — | — |
| 12 | — | 0.73 | — | — | — | — | — | — | — |
| 13 | — | 0.96 | — | — | — | — | — | — | — |
| 14 | — | 0.78 | — | — | — | — | — | — | — |
| 15 | — | 0.63 | — | — | — | — | — | — | — |
| 16 | — | 0.68 | — | — | — | — | — | — | — |
| 17 | — | — | — | — | 0.15 | — | — | — | — |
| 18 | — | — | — | — | — | — | — | — | — |
| 19 | 0.0008 | — | — | — | — | — | — | — | — |
| 20 | — | 0.90 | — | — | 0.22 | — | — | — | — |
| 21 | 0.0010 | 0.87 | — | — | — | — | — | — | — |
| 22 | — | 0.61 | 0.20 | — | — | — | — | — | — |
| 23 | — | 0.40 | — | 0.24 | — | — | — | — | — |
| 24 | — | 0.68 | — | — | — | 0.029 | — | — | — |
| 25 | — | 0.75 | 0.20 | — | 0.21 | — | — | — | — |
| 26 | — | 0.89 | — | — | 0.23 | 0.022 | — | — | — |

TABLE 2-continued

| Test No. | Chemical composition (continuation of Table 1, in mass %, balance is Fe and impurities) | | | | | | | | |
|---|---|---|---|---|---|---|---|---|---|
| | Ca | Cr | Mo | W | V | Nb | Ni | Cu | B |
| 27 | — | 0.70 | 0.18 | 0.16 | — | — | — | — | — |
| 28 | — | — | — | — | — | — | 1.61 | — | — |
| 29 | — | 0.61 | — | — | 0.22 | — | 1.57 | 0.21 | — |
| 30 | — | — | — | — | | — | 1.60 | 0.23 | — |
| 31 | 0.0010 | 0.72 | — | — | 0.22 | — | — | — | — |
| 32 | 0.0008 | 0.90 | — | — | — | — | — | — | — |
| 33 | — | 0.95 | — | — | — | — | — | — | — |
| 34 | — | 0.61 | — | — | — | — | — | — | — |
| 35 | — | 0.95 | — | — | — | — | — | — | — |
| 36 | — | 0.84 | — | — | — | — | — | — | — |
| 37 | — | 0.73 | — | — | — | — | — | — | — |
| 38 | — | 0.60 | — | — | — | — | — | — | — |
| 39 | — | 0.67 | — | — | — | — | — | — | — |
| 40 | — | 0.82 | — | — | — | — | — | — | — |
| 41 | — | 0.63 | — | — | 0.25 | 0.019 | — | — | — |
| 42 | — | 0.72 | — | — | — | — | — | — | — |
| 43 | — | 0.95 | — | — | — | — | — | — | — |
| 44 | — | 0.79 | — | — | — | — | — | — | — |
| 45 | — | 0.78 | — | — | — | — | — | — | — |
| 46 | — | 0.85 | — | — | — | — | — | — | 0.0021 |
| 47 | — | 0.82 | — | — | — | — | — | — | — |

TABLE 3

| Test No. | Ladle refining | Order of addition | Circulation time with finally added deoxidizer (min) | Swirling flow velocity (m/min) | RC (° C./min) |
|---|---|---|---|---|---|
| 1 | C | Al→REM | 6 | 0.2 | 20 |
| 2 | C | Al→REM | 6 | 0.2 | 29 |
| 3 | C | Al→REM | 6 | 0.2 | 21 |
| 4 | C | Al→REM | 6 | 0.25 | 21 |
| 5 | C | Al→REM | 6 | 0.25 | 23 |
| 6 | C | Al→REM | 6 | 0.2 | 19 |
| 7 | C | Al→REM | 8 | 0.15 | 22 |
| 8 | C | Al→REM | 8 | 0.35 | 22 |
| 9 | C | Al→REM | 8 | 0.3 | 13 |
| 10 | C | Al→REM | 8 | 0.2 | 12 |
| 11 | C | Al→REM | 8 | 0.2 | 16 |
| 12 | C | Al→REM | 8 | 0.2 | 18 |
| 13 | C | Al→REM | 10 | 0.25 | 25 |
| 14 | C | Al→REM | 10 | 0.2 | 23 |
| 15 | C | Al→REM | 10 | 0.2 | 21 |
| 16 | C | Al→REM | 6 | 0.2 | 15 |
| 17 | C | Al→REM | 8 | 0.2 | 27 |
| 18 | C | Al→REM | 8 | 0.2 | 13 |
| 19 | C | Al→REM | 8 | 0.2 | 22 |
| 20 | C | Al→REM | 8 | 0.2 | 17 |
| 21 | C | Al→REM | 8 | 0.2 | 14 |
| 22 | C | Al→REM | 8 | 0.2 | 27 |
| 23 | C | Al→REM | 8 | 0.2 | 14 |
| 24 | C | Al→REM | 8 | 0.2 | 14 |
| 25 | C | Al→REM | 8 | 0.2 | 29 |
| 26 | C | Al→REM | 8 | 0.2 | 12 |
| 27 | C | Al→REM | 8 | 0.2 | 10 |
| 28 | C | Al→REM | 8 | 0.2 | 14 |
| 29 | C | Al→REM | 8 | 0.2 | 24 |
| 30 | C | Al→REM | 8 | 0.2 | 14 |
| 31 | C | Al→REM | 8 | 0.2 | 11 |
| 32 | C | Al→REM | 8 | 0.2 | 27 |
| 33 | C | Al | 6 | 0.2 | 29 |
| 34 | NC | Al→REM | 6 | 0.2 | 23 |
| 35 | C | Al→REM | 3 | 0.2 | 17 |
| 36 | C | Al→REM | 6 | 0.05 | 18 |
| 37 | C | Al→REM | 6 | 0.3 | 20 |
| 38 | C | Al→REM | 6 | 0.2 | 12 |
| 39 | C | Al→REM | 3 | 0.2 | 19 |
| 40 | C | Al→REM | 6 | 0.2 | 30 |
| 41 | C | REM→Al | 8 | 0.2 | 26 |
| 42 | C | Al→REM→Ca | 6 | 0.2 | 110 |
| 43 | C | Al→REM→Ca | 6 | 0.2 | 0.06 |

TABLE 3-continued

| Test No. | Ladle refining | Order of addition | Circulation time with finally added deoxidizer (min) | Swirling flow velocity (m/min) | RC (° C./min) |
|---|---|---|---|---|---|
| 44 | C | Al | 6 | 0.2 | 14 |
| 45 | C | Al | 6 | 0.2 | 17 |
| 46 | C | Al | 6 | 0.2 | 16 |
| 47 | C | Al→REM | 8 | 0.2 | 27 |

The molten steels of Tests Nos. 1 to 47 shown in Tables 1 and 2 were subjected to refining under the conditions shown in Table 3. Specifically, in Tests Nos. 1 to 33 and 35 to 47, ladle refining was first performed on the molten steels. On the other hand, for the molten steel of Test No. 34, ladle refining was not performed. In the "Ladle refining" column in Table 3, "C" indicates that ladle refining was performed on the molten steel of the corresponding test number and "NC" indicates that ladle refining was not performed. The ladle refining was performed under the same conditions for all numbers of tests.

Specifically, in the ladle refining, the molten steels were circulated for 10 minutes using an RH apparatus. After the ladle refining was carried out, deoxidation was performed. The "Order of addition" column in Table 3 shows deoxidizers used and the order of addition of the deoxidizers. "Al→REM" indicates that after deoxidation was performed by addition of Al, further deoxidation was performed by addition of REM. "Al" indicates that only Al deoxidation was performed without performing deoxidation with another deoxidizer (e.g., REM). "REM→Al" indicates that REM deoxidation was performed and then Al deoxidation was performed. "Al→REM→Ca" indicates that Al deoxidation was performed and then REM deoxidation was performed and finally Ca deoxidation was performed. Metal Al was used for the Al deoxidation, a misch metal was used for the REM deoxidation, and a Ca—Si alloy and a flux of CaO:$CaF_2$=50:50 (mass ratio) were used for the Ca deoxidation. The circulation time in Table 3 is a circulation time after the final deoxidizer was added, i.e., the time of deoxidation with the finally added deoxidizer. When the finally added deoxidizer is REM, the time of the REM deoxidation is indicated.

In the cases in which REM deoxidation was performed, the circulation times (times of deoxidation) after addition of REM were as shown in Table 3. By the steps described above, the molten steels of Tests Nos. 1 to 47 were produced.

Using the produced molten steels, blooms (semi-finished products) having a transverse cross section of 300 mm×300 mm were produced by a continuous casting process. At that time, the molten steels within the mold were stirred by electromagnetic stirring. The velocities (m/min) of the swirling flows of the molten steels within the mold in the horizontal direction during stirring were as shown in Table 3. Using one of the produced blooms of each test number, the cooling rate RC (° C./min) of the blooms of each test number was determined in the above-described manner. The determined cooling rates RC are shown in Table 3.

The blooms were heated to 1200 to 1250° C. The heated blooms were subjected to billeting to produce billets having a transverse cross section of 160 mm×160 mm. The billets were heated to 1100° C. or more. After the heating, wire rods (spring steels) having a diameter of 15 mm were produced.

[Evaluation Test]

[Preparation of Ultrasonic Fatigue Test Specimens]

For each test number, the ultrasonic fatigue test specimen illustrated in FIG. 3A was prepared in the following manner. The numerical values in FIG. 3A indicate dimensions (in mm) at respective locations. "φ3" indicates that the diameter is 3 mm.

Figure 3A:
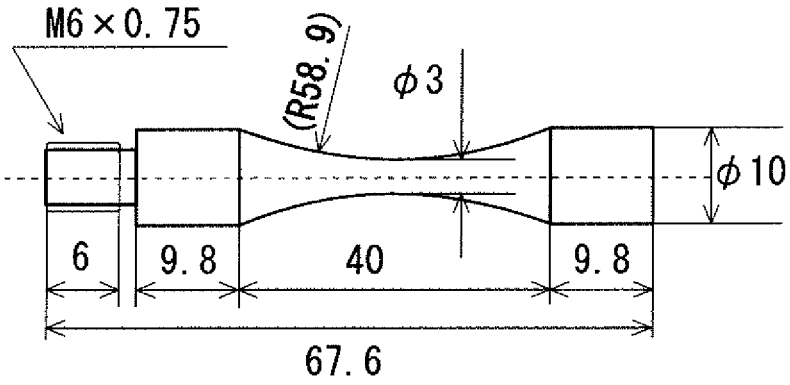
FIG. 3A is a side view of an ultrasonic fatigue test specimen.
Figure 3B:
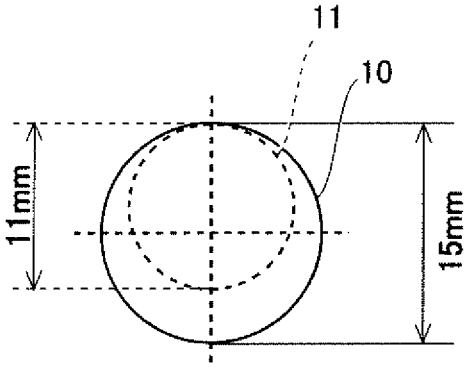
FIG. 3B is a schematic diagram illustrating a location for cutting a rough test specimen that serves as a material for the ultrasonic fatigue test specimen illustrated in FIG. 3A.

FIG. 3B is a view of a transverse cross section (cross section perpendicular to the axis of the wire rod) of the wire rod 10 having a diameter of 15 mm. The broken line in FIG. 3B indicates the location where a rough test specimen 11 (a test specimen 1 mm larger than the shape illustrated in FIG. 3A) for the ultrasonic fatigue test specimen is cut. The longitudinal direction of the rough test specimen 11 was the longitudinal direction of the wire rod 10. The rough test specimen 11 was cut at the cutting location illustrated in FIG. 3B so that the load bearing portion of the ultrasonic fatigue test specimen does not include the centerline segregation of the wire rod.

The rough test specimens cut from the wire rods of the respective test numbers were subjected to quenching and tempering to adjust the Vickers hardnesses (HV) of the rough test specimens to 500 to 540. For all numbers of tests, the quenching temperature was 900° C. and the holding time therefor was 20 minutes. For the test numbers in which the C content is greater than 0.50%, the tempering temperature was 430° C. and the holding time therefor was 20 minutes. For the test numbers in which the C content is not greater than 0.50%, the tempering temperature was 410° C. and the holding time therefor was 20 minutes.

After being heat treated as described above, the rough test specimens were given substantially the same properties as those of coiled springs. Thus, these rough test specimens were used for evaluation of the performance of the spring.

After the heat treatment, the rough test specimens were subjected to a finishing process to prepare a plurality of the ultrasonic fatigue test specimens having the dimensions illustrated in FIG. 3A for each test number.

[Measurement of Number TN of Coarse Oxide Inclusions and Maximum Value Dmax]

The prepared ultrasonic fatigue test specimens were each cut along the axial direction so as to form a cross section containing the central axis. The cross section of each ultrasonic fatigue test specimen was mirror polished. Selective Potentiostatic Etching by Electrolytic Dissolution (SPEED method) was performed on the polished cross section. In the cross section subjected to the SPEED method, 5 fields in the portion of 10 mm in diameter were freely selected. Each field was rectangular having a width of 2 mm in a radial direction and a length of 5 mm in an axial direction, with its center being located at a depth R/2 from the surface of the ultrasonic fatigue test specimen (R is the radius, 5 mm in this example).

Each field was observed using a scanning electron microscope (SEM) equipped with an energy dispersive X-ray microanalyzer (EDX). The observation was carried out at a magnification of 1000×. Inclusions in the fields were identified. Then, the chemical compositions of the identified inclusions were analyzed using the EDX to identify Al-based oxides, REM-containing complex oxides, and REM-containing complex oxysulfides. Furthermore, the equivalent circular diameter of each of the identified inclusions was determined by image analysis. Based on the results of analyzing the chemical compositions of the inclusions and the equivalent circular diameters of the inclusions, the numbers TN of coarse oxide inclusions and the maximum values Dmax of the oxide inclusions were determined.

[Ultrasonic Fatigue Test]

An ultrasonic fatigue test was conducted using the prepared ultrasonic fatigue test specimens. The testing system used was an ultrasonic fatigue testing system, USF-2000, manufactured by SHIMADZU CORPORATION. The frequency was set to 20 kHz and the test stress was set to 850 MPa to 1000 MPa. Six test specimens were used for each test number to carry out the ultrasonic fatigue test. The maximum load at which resonance of equal to or greater than $10^7$ cycles is possible is designated as the fatigue strength (MPa) of the test number.

[Vickers Hardness Test]

A Vickers hardness test in accordance with JIS Z 2244 was conducted using the prepared ultrasonic fatigue test specimens. The test force was set to 10 kgf=98.07 N. The hardness was measured at three freely selected points in the portion of 10 mm in diameter in each ultrasonic fatigue test specimen and the average value of the measurements was designated as the Vickers hardness (HV) of the test number.

[Charpy Impact Test]

Rough test specimens having a square transverse cross section of 11 mm×11 mm were prepared from the wire rods of the respective test numbers. The rough test specimens were subjected to quenching and tempering under the same conditions as those for the ultrasonic fatigue test specimens. Thereafter, they were subjected to a finishing process to prepare JIS No. 4 test specimens. In the finishing process, a U-notch was formed. The depth of the U notch was 2 mm. A Charpy impact test in accordance with JIS Z 2242 was conducted using the prepared test specimens. The test temperature was room temperature (25° C.).

[Tensile Test]

From the wire rods of all test numbers, rough test specimens 1 mm larger than the shape of a round bar test specimen having a flat portion of 6 mm in diameter (corresponding to the No. 14A test specimen specified in JIS Z 2201) were prepared. The rough test specimens were subjected to quenching and tempering under the same conditions as those for the ultrasonic fatigue test specimens. Thereafter, they were subjected to a finishing process to prepare round bar test specimens. In accordance with JIS Z 2241, a tensile test was conducted at room temperature (25° C.) to determine the elongation at break (%) and the reduction in area (%).

[Test Results]

The test results are shown in Table 4.

TABLE 4

| Test No. | Casting results | Main inclusions | TN (number/mm$^2$) | Dmax (μm) | Fatigue strength (MPa) | Hardness (HV) | Charpy (×10$^4$ J/m$^2$) | Elongation (%) | Reduction in area (%) |
|---|---|---|---|---|---|---|---|---|---|
| 1 | S | REM-Al—O—S | 0.052 | 33 | 957 | 532 | 58.5 | 10.1 | 57.7 |
| 2 | S | REM-Al—O—S | 0.032 | 40 | 954 | 517 | 56.8 | 10.7 | 59.4 |
| 3 | S | REM-Al—O—S | 0.031 | 38 | 971 | 531 | 62.9 | 10.2 | 53.8 |
| 4 | S | REM-Al—O—S | 0.087 | 34 | 978 | 518 | 49.5 | 11.2 | 54.6 |
| 5 | S | REM-Al—O—S | 0.037 | 32 | 958 | 538 | 63.7 | 11.5 | 55.2 |
| 6 | S | REM-Al—O—S | 0.075 | 26 | 955 | 523 | 74.2 | 11.0 | 56.1 |
| 7 | S | REM-Al—O—S | 0.063 | 32 | 958 | 534 | 64.0 | 10.8 | 60.4 |
| 8 | S | REM-Al—O—S | 0.076 | 36 | 978 | 537 | 71.6 | 12.0 | 56.3 |
| 9 | S | REM-Al—O—S | 0.021 | 27 | 974 | 516 | 69.4 | 10.7 | 55.4 |
| 10 | S | REM-Al—O—S | 0.083 | 39 | 961 | 514 | 66.6 | 12.8 | 61.0 |
| 11 | S | REM-Al—O—S | 0.030 | 31 | 951 | 515 | 60.2 | 11.3 | 53.3 |
| 12 | S | REM-Al—O—S | 0.065 | 31 | 961 | 527 | 60.9 | 11.6 | 53.5 |
| 13 | S | REM-Al—O—S | 0.065 | 30 | 975 | 519 | 60.8 | 10.8 | 53.8 |
| 14 | S | REM-Al—O—S | 0.074 | 32 | 956 | 517 | 59.8 | 11.3 | 52.1 |
| 15 | S | REM-Al—O—S | 0.049 | 26 | 968 | 535 | 58.6 | 10.2 | 59.7 |
| 16 | S | REM-Al—O—S | 0.044 | 26 | 970 | 525 | 50.2 | 12.0 | 59.6 |
| 17 | S | REM-Al—O—S | 0.086 | 35 | 964 | 535 | 50.9 | 10.7 | 53.2 |
| 18 | S | REM-Al—O—S | 0.037 | 30 | 972 | 522 | 58.6 | 10.8 | 53.6 |
| 19 | S | REM-Al—O—S | 0.070 | 32 | 955 | 533 | 55.6 | 11.1 | 53.2 |
| 20 | S | REM-Al—O—S | 0.087 | 39 | 952 | 511 | 58.3 | 11.3 | 52.3 |
| 21 | S | REM-Al—O—S | 0.070 | 26 | 970 | 539 | 62.1 | 10.7 | 58.1 |
| 22 | S | REM-Al—O—S | 0.038 | 31 | 957 | 527 | 56.5 | 10.5 | 53.4 |
| 23 | S | REM-Al—O—S | 0.040 | 31 | 952 | 512 | 50.8 | 11.5 | 53.2 |
| 24 | S | REM-Al—O—S | 0.073 | 39 | 973 | 532 | 60.5 | 10.9 | 59.3 |
| 25 | S | REM-Al—O—S | 0.053 | 27 | 978 | 522 | 55.1 | 9.8 | 55.4 |
| 26 | S | REM-Al—O—S | 0.068 | 26 | 974 | 535 | 49.5 | 10.3 | 54.1 |
| 27 | S | REM-Al—O—S | 0.027 | 28 | 963 | 539 | 53.4 | 11.2 | 55.0 |
| 28 | S | REM-Al—O—S | 0.045 | 32 | 977 | 529 | 63.6 | 10.9 | 56.9 |
| 29 | S | REM-Al—O—S | 0.038 | 33 | 952 | 526 | 53.7 | 11.8 | 53.8 |
| 30 | S | REM-Al—O—S | 0.081 | 35 | 979 | 534 | 63.3 | 9.7 | 53.3 |
| 31 | S | REM-Al—O—S | 0.022 | 39 | 971 | 529 | 50.7 | 10.4 | 58.1 |
| 32 | S | REM-Al—O—S | 0.041 | 36 | 976 | 510 | 54.1 | 11.1 | 54.6 |
| 33 | S | Al—O | 0.255 | 45 | 895 | 540 | 38.6 | 7.8 | 44.3 |
| 34 | S | Al—O, REM-Al—O—S | 0.32 | 46 | 891 | 514 | 60.1 | 11.4 | 54.6 |
| 35 | S | Al—O, REM-Al—O—S | 0.11 | 47 | 896 | 535 | 62.5 | 11.5 | 55.7 |
| 36 | S | Al—O | 0.25 | 19 | 920 | 511 | 49.1 | 10.7 | 57.3 |
| 37 | F | — | — | — | — | — | — | — | — |
| 38 | S | REM-Al—O—S | 0.356 | 36 | 916 | 539 | 58.5 | 10.7 | 53.1 |
| 39 | S | Al—O | 0.400 | 33 | 892 | 519 | 48.3 | 8.9 | 48.2 |
| 40 | S | REM-Al—O—S | 0.044 | 30 | 902 | 539 | 62.4 | 10.5 | 55.6 |
| 41 | S | Al—O, REM-Al—O—S | 0.250 | 37 | 906 | 514 | 60.5 | 11.9 | 59.3 |
| 42 | S | REM-Al—O—S | 0.452 | 48 | 910 | 532 | 58.7 | 10.1 | 53.4 |
| 43 | S | Al—O, REM-Al—O—S | 0.489 | 52 | 891 | 520 | 55.1 | 10.3 | 59.9 |
| 44 | S | Al—O | 0.221 | 49 | 871 | 529 | 56.5 | 10.0 | 58.7 |
| 45 | S | Al—O, MnS | 0.322 | 54 | 911 | 523 | 40.5 | 8.2 | 45.7 |
| 46 | S | Al—O | 0.312 | 44 | 909 | 532 | 55.4 | 10.6 | 54.6 |
| 47 | S | REM-Al—O—S | 0.083 | 30 | 959 | 524 | 39.8 | 9.2 | 48.5 |

In Table 4, in the "Casting results" column, "S" means that casting was accomplished without causing nozzle clogging. "F" means that the nozzle became clogged during casting. The "Main inclusions" column lists oxide inclusions that had an area fraction of not less than 5% in the five fields in the SEM observation. "REM-Al—O—S" refers to complex oxysulfides. "Al—O" refers to Al-based oxides. "MnS" refers to MnS. In Tests Nos. 1 to 32 and 34 to 47, complex oxides having an area fraction of less than 5% were also present in the steels.

Referring to Table 4, in Tests Nos. 1 to 32, the chemical compositions were appropriate. Furthermore, in all of them, the number TN of coarse oxide inclusions was not greater than 0.2/mm$^2$ and the maximum value Dmax among equivalent circular diameters of the oxide inclusions was not greater than 40 μm. As a result, the fatigue strengths of Tests Nos. 1 to 32 were all high at 950 MPa or greater.

Furthermore, the chemical compositions of Tests Nos. 5 to 10 included B. As a result, they had high Charpy impact values and exhibited excellent toughness compared with Tests Nos. 1 to 4 and 11 to 32.

On the other hand, in Test No. 33, the chemical composition did not include REM. As a result, neither complex oxides nor complex oxysulfides formed, and the number TN of coarse oxide inclusions exceeded 0.2/mm$^2$ and further the maximum value Dmax of the oxide inclusions exceeded 40 μm. Consequently, the fatigue strength was low at less than 950 MPa. Furthermore, in Test No. 33, the chemical composition did not include Ti. As a result, the Charpy impact value was less than 40×10$^4$ J/m$^2$ and the toughness was low.

Furthermore, the elongation at break was less than 9.5% and the reduction in area was less than 50%.

In Test No. 34, the O content was too high. As a result, the number TN was too high and the maximum value Dmax was too great. Consequently, the fatigue strength was low at less than 950 MPa.

In Test No. 35, the chemical composition was appropriate. However, the circulation time in REM deoxidation was too short. As a result, the maximum value Dmax exceeded 40 μm. Consequently, the fatigue strength was low at less than 950 MPa.

In Test No. 36, the chemical composition was appropriate. However, electromagnetic stirring within the mold was insufficient and the flow velocity within the mold was less than 0.1 m/min. As a result, the number TN was too high. Consequently, the fatigue strength was low at less than 950 MPa.

In Test No. 37, the REM content was excessively high. As a result, nozzle clogging occurred during continuous casting and therefore a semi-finished product could not be produced.

In Test No. 38, the REM content was too high. As a result, coarse oxide inclusions in the steel increased, resulting in the excessively high number TN. Consequently, the fatigue strength was low at less than 950 MPa.

In Test No. 39, the REM content was too low. As a result, neither complex oxides nor complex oxysulfides formed and therefore Al-based oxides became coarse, resulting in the excessively high number TN. Consequently, the fatigue strength was low at less than 950 MPa. In addition, the too low REM content resulted in the low elongation at break of less than 9.5% and the low reduction in area of less than 50%. It is considered that the too low REM content caused formation of TiS at the grain boundaries resulting in the decreased ductility.

In Tests Nos. 40 and 41, the Ti content was too high. Consequently, the fatigue strength was low at less than 950 MPa. It is considered that coarse TiN had formed and this resulted in the decreased fatigue strength.

In Test No. 42, the chemical composition was appropriate but the cooling rate RC during continuous casting was too fast. As a result, the number TN was too high and the maximum value Dmax was too great. Consequently, the fatigue strength was low at less than 950 MPa.

In Test No. 43, the chemical composition was appropriate but the cooling rate RC was too slow. As a result, the number TN was too high and the maximum value Dmax was too great. Consequently, the fatigue strength was low at less than 950 MPa.

In Tests Nos. 44 to 46, none of the chemical compositions included REM. As a result, the number TN was too high and the maximum value Dmax was too great. Consequently, the fatigue strength was low at less than 950 MPa.

In addition, in Test No. 45, the Ti content in the chemical composition was too low. As a result, the Charpy impact value was approximately $40\times10^4$ J/m$^2$ and the toughness was low. Furthermore, the elongation at break was less than 9.5% and the reduction in area was less than 50%.

In Test No. 47, the Ti content in the chemical composition was too low. As a result, the Charpy impact value was less than $40\times10^4$ J/m$^2$ and the toughness was low. Furthermore, the elongation at break was less than 9.5% and the reduction in area was less than 50%.

In the foregoing specification, an embodiment of the present invention has been described. However, it is to be understood that the above embodiment is merely an illustrative example by which the present invention is implemented. Thus, the present invention is not limited to the above embodiment, and modifications of the above embodiment may be made appropriately without departing from the spirit and scope of the invention.

The invention claimed is:

1. A spring steel having a chemical composition consisting of, in mass %,

C: 0.4 to 0.7%,

Si: 1.1 to 3.0%,

Mn: 0.3 to 1.5%,

P: equal to or less than 0.03%,

S: equal to or less than 0.05%,

Al: 0.01 to 0.05%, rare earth metal: 0.0001 to 0.002%,

N: equal to or less than 0.015%,

O: equal to or less than 0.0030%,

Ti: 0.02 to 0.1%,

Ca: 0 to 0.0030%,

Cr: 0 to 2.0%,

Mo: 0 to 1.0%,

W: 0 to 1.0%,

V: 0 to 0.70%,

Nb: 0 to less than 0.050%,

Ni: 0 to 3.5%,

Cu: 0 to 0.5%, and

B: 0 to 0.0050%, with the balance being Fe and impurities, wherein a number of oxide inclusions having an equivalent circular diameter of equal to or greater than 5 μm is equal to or less than 0.2/mm$^2$, the oxide inclusions each being one of an Al-based oxide, a complex oxide containing REM, O and Al, and a complex oxysulfide containing REM, O, S, and Al, and wherein a maximum value among equivalent circular diameters of the oxide inclusions is equal to or less than 40 μm.

2. The spring steel according to claim 1, wherein the chemical composition includes Ca: 0.0001 to 0.0030%.

3. The spring steel according to claim 1, wherein the chemical composition includes one or more selected from the group consisting of, Cr: 0.05 to 2.0%, Mo: 0.05 to 1.0%, W: 0.05 to 1.0%, V: 0.05 to 0.70%, Nb: 0.002 to less than 0.050%, Ni: 0.1 to 3.5%, Cu: 0.1 to 0.5%, and B: 0.0003 to 0.0050%.

4. The spring steel according to claim 2, wherein the chemical composition includes one or more selected from the group consisting of, Cr: 0.05 to 2.0%, Mo: 0.05 to 1.0%, W: 0.05 to 1.0%, V: 0.05 to 0.70%, Nb: 0.002 to less than 0.050%, Ni: 0.1 to 3.5%, Cu: 0.1 to 0.5%, and B: 0.0003 to 0.0050%.

5. A method for producing a spring steel, the method comprising the steps of:

refining molten steel having the chemical composition according to claim 1;

producing a semi-finished product from the refined molten steel by a continuous casting process; and hot working the semi-finished product, wherein the step of refining the molten steel includes the steps of:

performing ladle refining on the molten steel;

deoxidizing the molten steel using Al subsequent to the ladle refining; and deoxidizing the molten steel using REM for at least 5 minutes after the deoxidation with Al, and wherein the step of producing the semi-finished product includes the steps of:

stirring the molten steel within a mold to swirl the molten steel in a horizontal direction at a flow velocity of 0.1 m/min or faster; and cooling the semi-finished product being cast at a cooling rate of 1 to 100° C./min.

* * * * *